US006162983A

United States Patent [19]

Takahashi

[11] Patent Number: 6,162,983

[45] Date of Patent: Dec. 19, 2000

[54] MUSIC APPARATUS WITH VARIOUS MUSICAL TONE EFFECTS

[75] Inventor: Makoto Takahashi, Hamamatsu, Japan

[73] Assignee: Yamaha Corporation, Hamamatsu, Japan

[21] Appl. No.: 09/375,736

[22] Filed: Aug. 17, 1999

[30] Foreign Application Priority Data

Aug. 21, 1998 [JP] Japan ..... 10-236049

[51] Int. Cl.[7] ..... G10H 1/18

[52] U.S. Cl. ..... 84/615; 84/653

[58] Field of Search ..... 84/609–620, 622–638, 84/649–658, 662–669

[56] References Cited

U.S. PATENT DOCUMENTS

| | | | |
|---|---|---|---|
| 5,247,128 | 9/1993 | Suzuki . | |
| 5,281,754 | 1/1994 | Farrett et al. | 84/609 |
| 5,693,902 | 12/1997 | Hufford et al. | 84/609 X |
| 5,712,436 | 1/1998 | Sakama et al. | 84/610 |
| 5,831,195 | 11/1998 | Nakata | 84/609 |
| 5,913,258 | 6/1999 | Tamura | 84/609 X |
| 5,920,025 | 7/1999 | Itoh et al. | 84/611 |
| 5,952,598 | 9/1999 | Goede | 84/609 |
| 6,002,080 | 12/1999 | Tanaka | 84/615 |

FOREIGN PATENT DOCUMENTS 3-113499 5/1991 Japan .

*Primary Examiner*—Stanley J. Witkowski
*Attorney, Agent, or Firm*—Morrison & Foerster

[57] ABSTRACT

A music apparatus capable of adding various effects to musical sounds comprises: a processor; a waveform generator; and a program memory storing instructions for causing the processor to execute a musical sound generating process according to first performance information, the musical sound generating process comprising the steps of: (a) receiving the first performance information; (b) creating second performance information according to said received first performance information or third performance information formed by processing said created second performance information; (c) selectively repeating said creating step (b); (d) selectively designating said repeatedly creating step (c) to create fourth performance information different from the previously created performance information; and (e) generating musical sound according to the second, third or fourth performance information.

8 Claims, 13 Drawing Sheets

| | | | |
|---|---|---|---|
| NON | CHANNEL NUMBER | NOTE NUMBER | VELOCITY |

| | | | |
|---|---|---|---|
| NOFF | CHANNEL NUMBER | NOTE NUMBER | VELOCITY |

SPEAKER
17
SOUND SYSTEM
16
TONE GENERATOR
15
RAM
14
ROM
13
CPU
12
BUS
11
DISPLAY
22
INTERFACE
20
EXTERNAL MUSIC APPARATUS
21
CONSOLE PANEL
19
STORAGE UNIT
18

MUSIC APPARATUS WITH VARIOUS MUSICAL TONE EFFECTS

This application is based on Japanese Patent Application HEI 10-236049, filed on Aug. 21, 1998, the entire contents of which are incorporated herein by reference.

BACKGROUND OF THE INVENTION a) Field of the Invention

The present invention relates to a music apparatus, and more particularly to a music apparatus capable of adding effects to musical sounds.

b) Description of the Related Art

A musical instrument digital interface (MIDI) specification defines an interface for interconnecting a plurality of electronic musical instruments. An electronic musical instrument in conformity with the MIDI specification has a MIDI interface.

For example, a keyboard and a tone generator each equipped with a MIDI interface can be connected by a MIDI cable. As a player gives a musical performance (key depression/release) on the keyboard, MIDI data corresponding to the performance is supplied from the keyboard to the tone generator which in turn generates musical tones. If a speaker is connected to the tone generator, musical sounds can be produced from the speaker.

If an effector is connected between the tone generator and speaker, various effects can be added to musical tones. Effects are, for example, echo, delay, chorus, reverberation and the like. Most of effectors give various effects to analog musical tone signals.

It has been desired to increase the number of variations of effects to be given to musical tones. If a plurality type of effectors are used in combination, variations of effects can be increased.

The number of variations obtained by a combination of effectors is, however, limited. A further increase in the number of variations has been desired.

SUMMARY OF THE INVENTION

It is an object of the present invention to provide a music apparatus capable of adding various effects to music sounds.

According to one aspect of the present invention, there is provided a music apparatus comprising: a processor; a waveform generator; and a program memory storing instructions for causing the processor to execute a musical sound generating process according to first performance information, the musical sound generating process comprising the steps of: (a) receiving the first performance information; (b) creating second performance information according to said received first performance information or third performance information formed by processing said created second performance information; (c) selectively repeating said creating step (b); (d) selectively designating said repeatedly creating step (c) to create fourth performance information different from the previously created performance information; and (e) generating musical sound according to the second, third or fourth performance information.

According to another aspect of the present invention, there is provided a music apparatus comprising: a processor; an input device for inputting first performance information; a waveform generator; and a program memory storing instructions for causing the processor to execute a musical sound generating process according to the first performance information, the musical sound generating process comprising the steps of: (a) inputting the first performance information; (b) creating second performance information according to said input first performance information or third performance information formed by processing said created second performance information; (c) selectively repeating said creating step (b); (d) selectively controlling number of repeating said repeatedly creating step (c); and (e) generating musical sound according to the second, third or fourth performance information.

In repetitively producing musical sounds of performance data, for example, the sound volume can be lowered gradually or it can be alternately and repetitively changed large or small. It is possible to set so that not only the effect degree is made large or small but also each piece of repetitively generated performance is arranged in a different way.

Each piece of performance information may be arranged independently or collectively by using a predetermined function such as a sequential increase function of the parameter value by 10% or by using preset values.

DETAILED DESCRIPTION OF THE PREFERRED EMBODIMENTS

Figure 1:
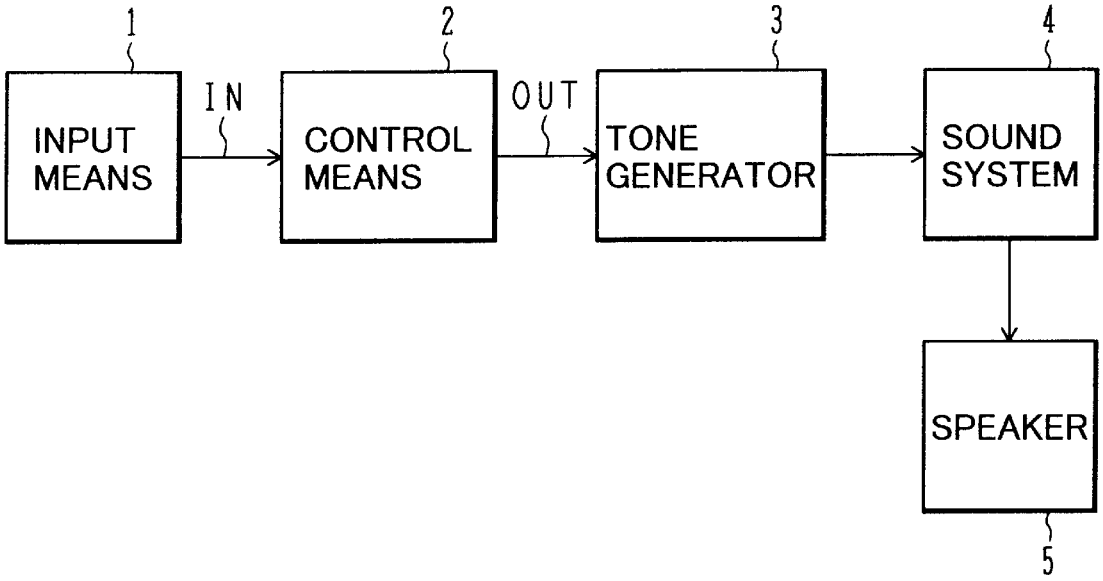
FIG. 1 is a block diagram showing the structure of a music apparatus according to an embodiment of the invention.

FIG. 1 is a block diagram showing the structure of a music apparatus according to an embodiment of the invention. The music apparatus is, for example, a sequencer or an electronic musical instrument. The sequencer stores performance data in its memory and can produce musical sounds in accordance with the performance data. The electronic musical instrument is, for example, an electronic keyboard musical instrument or an electronic guitar and can produce musical sounds in accordance with musical performance made by a player.

An input means 1 supplies performance data IN in the memory or performance data IN corresponding to musical performance made by a player. The input means 1 may supply performance data IN externally supplied via a MIDI interface. The performance data IN is, for example, MIDI data.

Figures 2A, 2B, 2C:
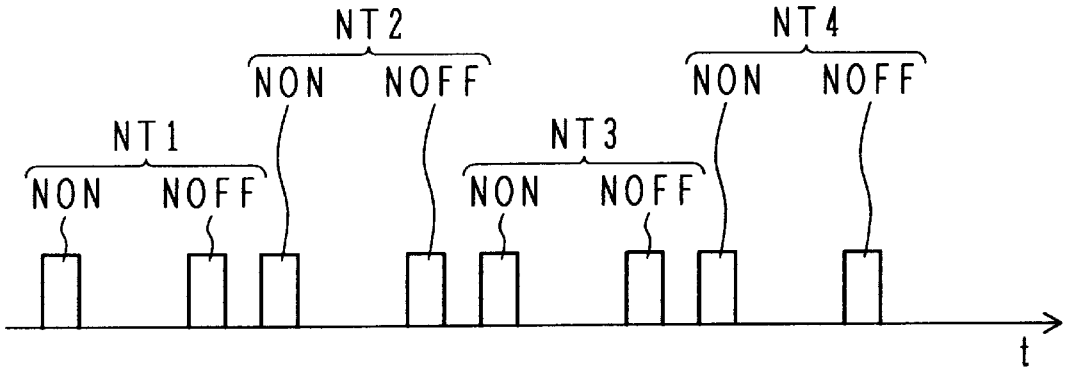
FIGS. 2A to 2C are diagrams showing the structure of input performance data (MIDI data).

FIG. 2A shows an example of a timing chart of performance data (MIDI data) IN. The abscissa represents time. The input means 1 time sequentially supplies, for example, four notes NT1, NT2, NT3 and NT4.

Each of the notes NT1 to NT4 has a note-on event NON and a note-off event NOFF. The note-on event NON indicates a sound generation start, and the note-off event NOFF indicates a sound generation end (mute).

FIG. 2B shows the structure of the note-on event NON. The note-on event NON occurs, for example, when a player depresses a key, and is made of three bytes. A portion of the first byte indicates a channel number. The number of channels is, for example, 16, and the channel number indicates one of 16 channels. The second byte indicates a note number (pitch). The third byte indicates a velocity (volume).

FIG. 2C shows the structure of the note-off event NOFF. The note-off event NOFF occurs, for example, when a player releases a key, and is made of three bytes. A portion of the first byte indicates a channel number. The second byte indicates a note number (pitch). The third byte indicates a velocity.

Reverting to FIG. 1, a control means 2 adds effects to the input performance data IN and outputs performance data OUT. For example, the performance data OUT is musical tone parameters for controlling a tone generator 3. How the control means 2 arranges the performance data IN to generate the performance data OUT will be later detailed with reference to FIG. 3.

The tone generator 3 generates musical tone signals in accordance with the performance data OUT and supplies them to a sound system 4. The sound system 4 has a D/A converter and an amplifier. The D/A converter converts digital musical tone signals into analog musical tone signals which are amplified by the amplifier and supplied to a speaker 4. The speaker 5 produces musical sounds in accordance with the musical tone signals.

Figure 3:
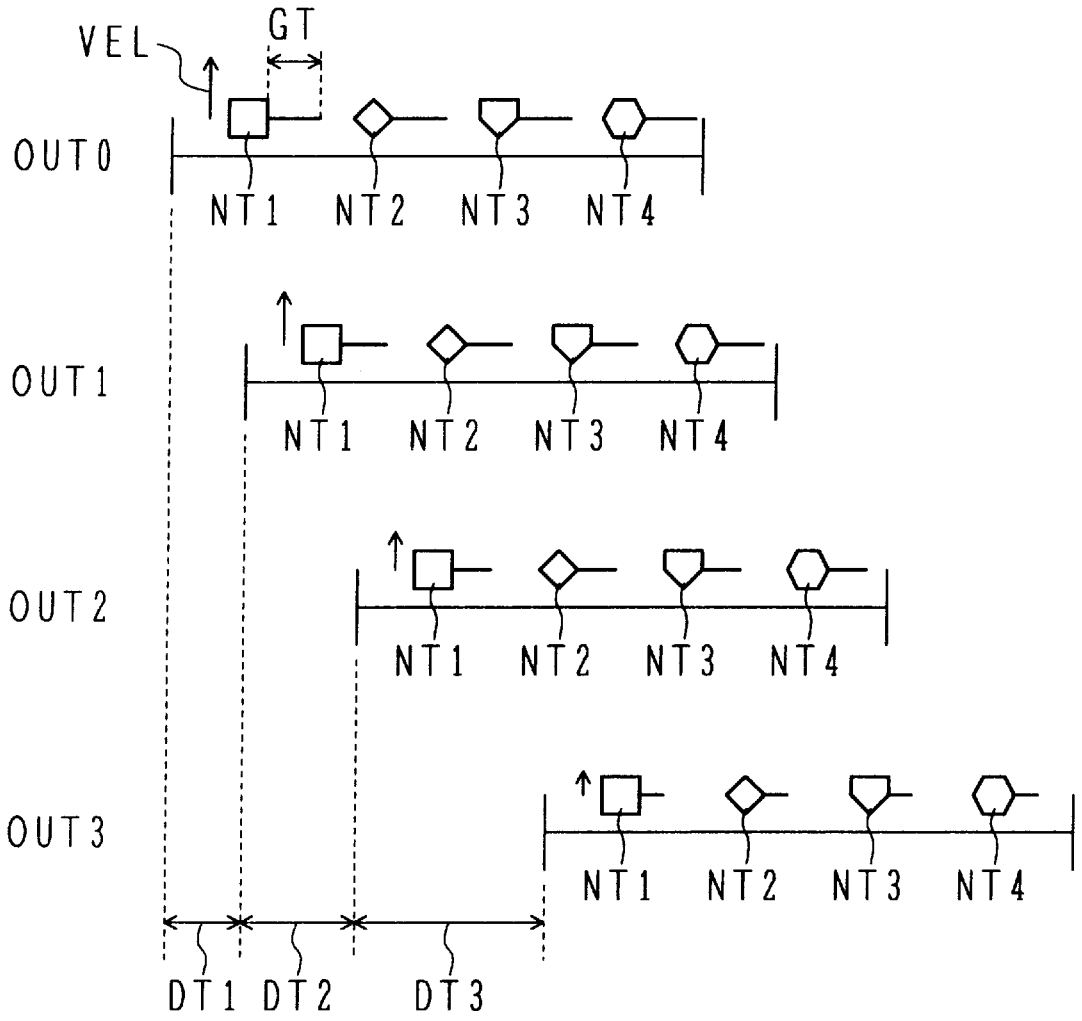
FIG. 3 is a diagram showing the structure of output performance data (tone parameters).

FIG. 3 is a timing chart of performance data (musical tone parameter) OUT generated by the control means 2. The abscissa represents time.

The control means 2 generates effect sound data OUT1, OUT2 and OUT3 as well as original sound data OUT 0, in accordance with the performance data IN. If it is set that a musical tone is not given effects, only the original sound data is output. If it is set that a musical tone is given effects, a synthesized musical tone signal of performance data OUT0 to OUT 4 is output. The effect sound data OUT1 to OUT3 represents echoes corresponding to a threefold of the original sound data OUT0.

The operation when the performance data (MIDI data) IN such as shown in FIG. 2A is input to the control means 2 will be described. The control means 2 generates and outputs musical tone parameters OUT0 of the original sounds in accordance with the input performance data IN.

The musical tone parameters OUT0 include four notes NT1 to NT4. These four notes NT1 to NT4 correspond to the four notes NT1 to NT4 of the performance data IN shown in FIG. 2A. Each of the notes NT1 to NT4 of the musical tone parameters OUT0 includes a velocity (volume) VEL parameter, a gate time (sound generation time) GT parameter, and a note number (pitch) parameter.

The first to third effect sound data OUT1 to OUT3 are sound data delayed from the original sound data OUT0. The first effect sound data OUT1 is delayed by a time DT1 from the original sound data OUT0. The second effect sound data OUT2 is delayed by a time DT2 from the first effect sound data OUT1. The delay time DT2 is longer than the delay time DT1. The third effect sound data OUT3 is delayed by a time DT3 from the second effect sound data OUT2. The delay time DT3 is longer than the delay time DT2. The delay time DT1 to DT3 becomes longer, the more the effect sound data is repeated.

The velocity VEL, gate time GT and/or pitch of each of the musical tone parameters OUT0, OUT1, OUT2 and OUT3 can be changed. For example, as an echo is repeated, the velocity VEL becomes gradually small and the gate time Gt becomes gradually short.

The number of echo repetitions is not limited to three, but a player can set it as desired. A change amount of the above-described velocity VEL, gate time GT and pitch can also be set by a player as desired. Next, an example of settings for reproducing sounds after a ball is dropped on a floor will be described.

Figure 4A:
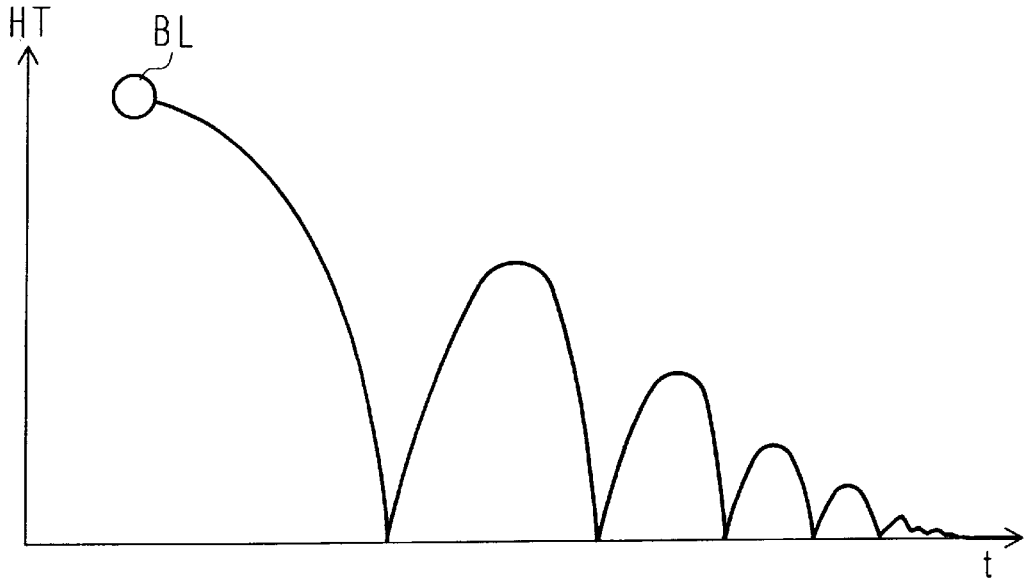
FIG. 4A is a graph showing a vertical height of a ball relative to time.
Figure 4B:
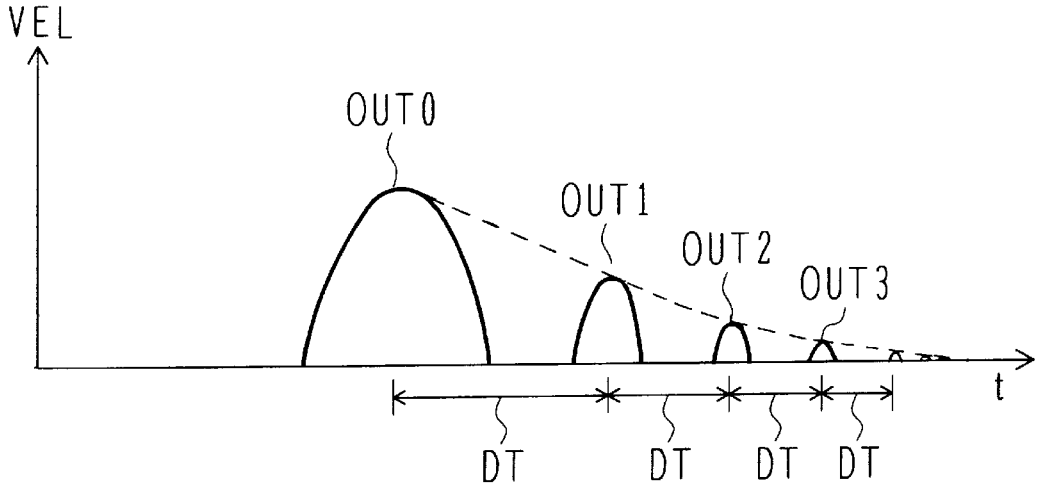
FIG. 4B is a graph showing a velocity of ball sounds relative to time.

FIG. 4A is a graph showing a vertical height HT of a ball BL relative to time t, and FIG. 4B is a graph showing a velocity (sound) VEL of the ball BL relative to time t.

Each time the ball BL bounds up from the floor, sounds OUT0, OUT1, OUT2 and OUT3 are generated. The maximum values of the bound height HT of the ball BL change smaller with time. Namely, the velocities VEL of the ball sounds OUT0 to OUT3 become small with time.

The time interval of bound of the ball BL becomes gradually short. Namely, the delay times DT representative of the time intervals between the ball sounds OUT0 to OUT3 become gradually short. Since the maximum values of the bound height HT of the ball BL become gradually small, the pitch and gate time of the ball sounds OUT0 to OUT3 change with time.

As described above, various effects can be given to musical tone signals by properly setting the parameters such as the number of echo repetitions, velocity VEL, delay time DT, pitch and gate time.

Figure 5A:
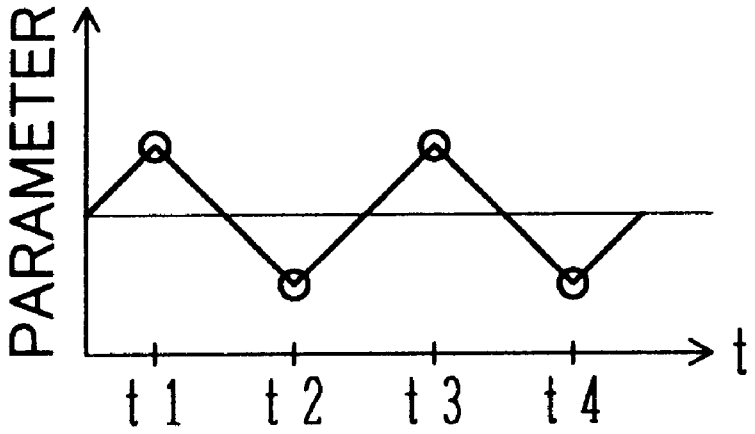
FIGS. 5A and 5B are graphs showing a change in parameter values relative to time.
Figure 5B:
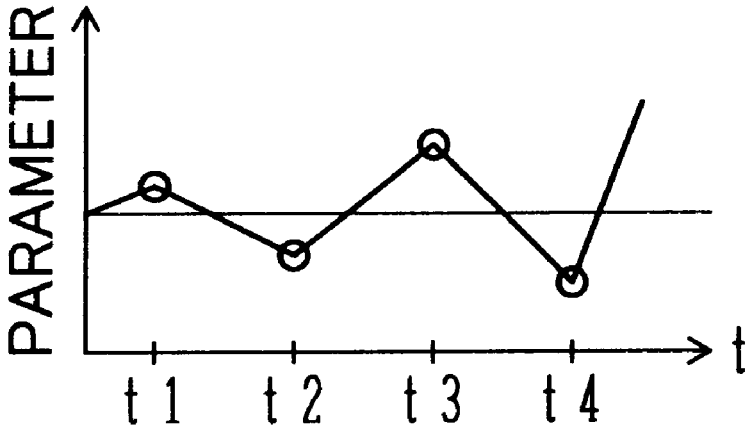

The parameters are not limited only to those which become gradually large or small. As shown in FIG. 5A, the parameter values may be repetitively changed large or small with time, with a constant parameter change amount being set. Alternatively, as shown in FIG. 5B, the parameter values may be repetitively changed large or small with time, with a parameter change amount being gradually increased.

Although the control means 2 shown in FIG. 2 receives MIDI data as the performance data IN and outputs musical tone parameters as the performance data OUT, the embodiment is not limited only to this. For example, both the performance data IN and OUT may be MIDI data or musical tone parameter data.

Figure 6:
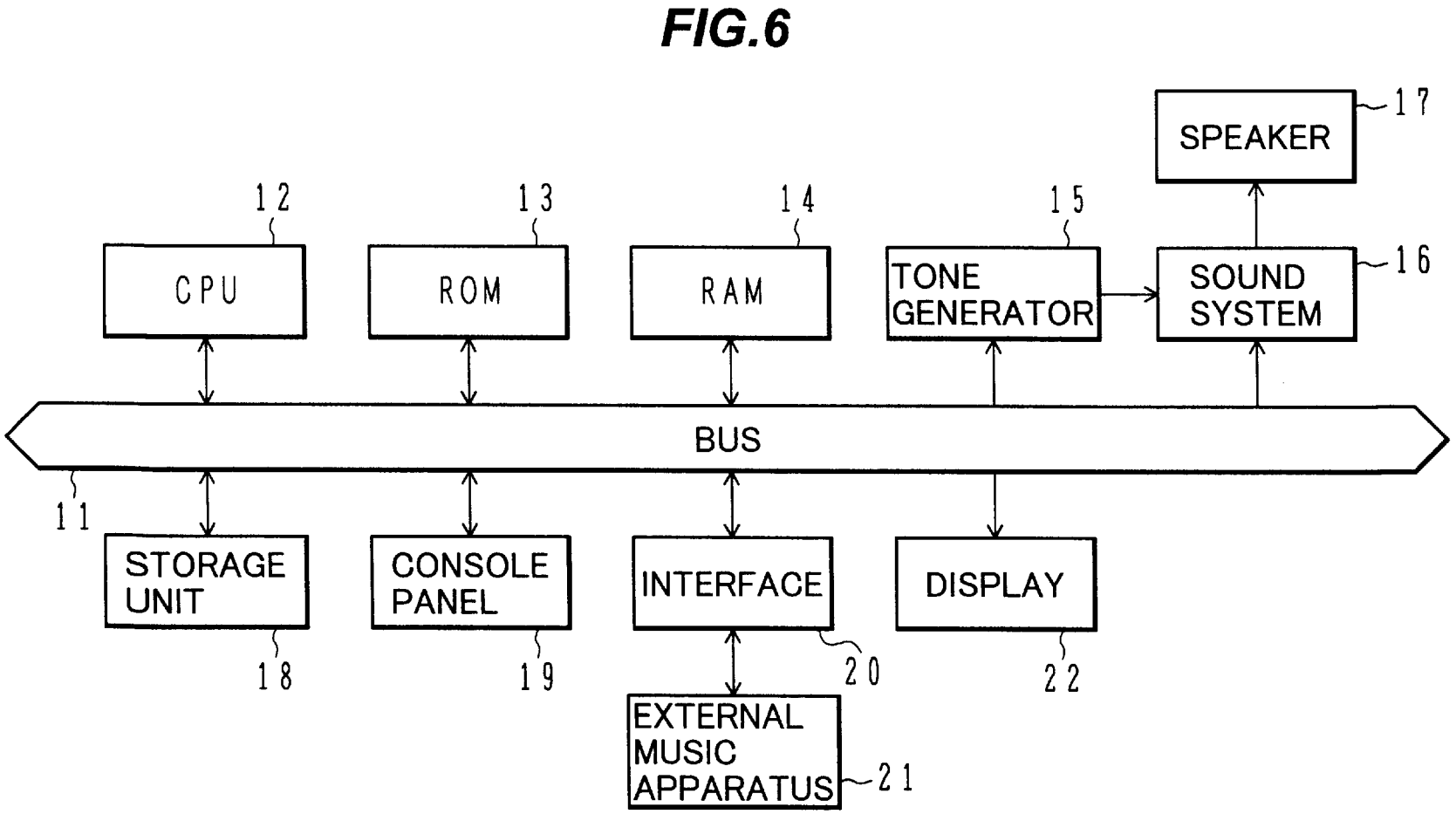
FIG. 6 is a block diagram showing the hardware structure of a music apparatus.

FIG. 6 is a block diagram showing the hardware structure of the music apparatus described above.

A CPU 12, a ROM 13, a RAM 14, a tone generator 15, a sound system 16, a storage unit 18, a console panel 19, an interface 20 and a display 22 are all connected to a bus 11.

CPU 12 controls the above-described components connected to the bus 11 and executes various operations, in accordance with a computer program stored in RAM 14 or ROM 13. ROM 13 and/or RAM 14 store(s) computer programs, performance data, and various parameters. RAM 14 also has working areas such as buffers, registers and flags.

The tone generator 15 is, for example, a PCM tone generator, an FM tone generator, a physical model tone generator, or a format tone generator, and receives musical tone parameters via the bus 11 to supply musical tone signals to the sound system 16.

The sound system 16 has a D/A converter and an amplifier. The D/A converter converts digital musical tone signals into analog musical tone signals which are amplified by the amplifier. A speaker 17 is connected to the sound system 16 and produces musical sounds corresponding to musical tone signals.

The storage unit 18 may be a hard disk drive, a floppy disk drive, a CD-ROM drive or a magnetic optical disk drive, and can store computer programs, performance data and various parameters. The contents stored in the storage unit 18 may be copied to RAM 14. Distribution and version-up of computer programs and the like can therefore be made easy.

The console panel 19 has operators to be used for instructing a performance start or stop and for setting the above-described effect parameters. As a player operates upon these operators, such instructions and settings can be performed.

The interface 20 is, for example, a MIDI interface, and connectable to an external music apparatus 21. The external music apparatus 21 is, for example, performance operators such as keyboards. The interface 20 can receive performance data from the external music apparatus 21. It is possible to add effect parameters described above to the performance data.

The interface 20 is not limited only to the MIDI interface, but it may be a communications interface for the Internet or the like. Computer programs, performance data and the like may be supplied via such communications interface.

The display 22 can display various information. For example, it can display effect parameter values set from the console panel 22. A player can set effect parameters while referring to the display 22.

Figure 7:
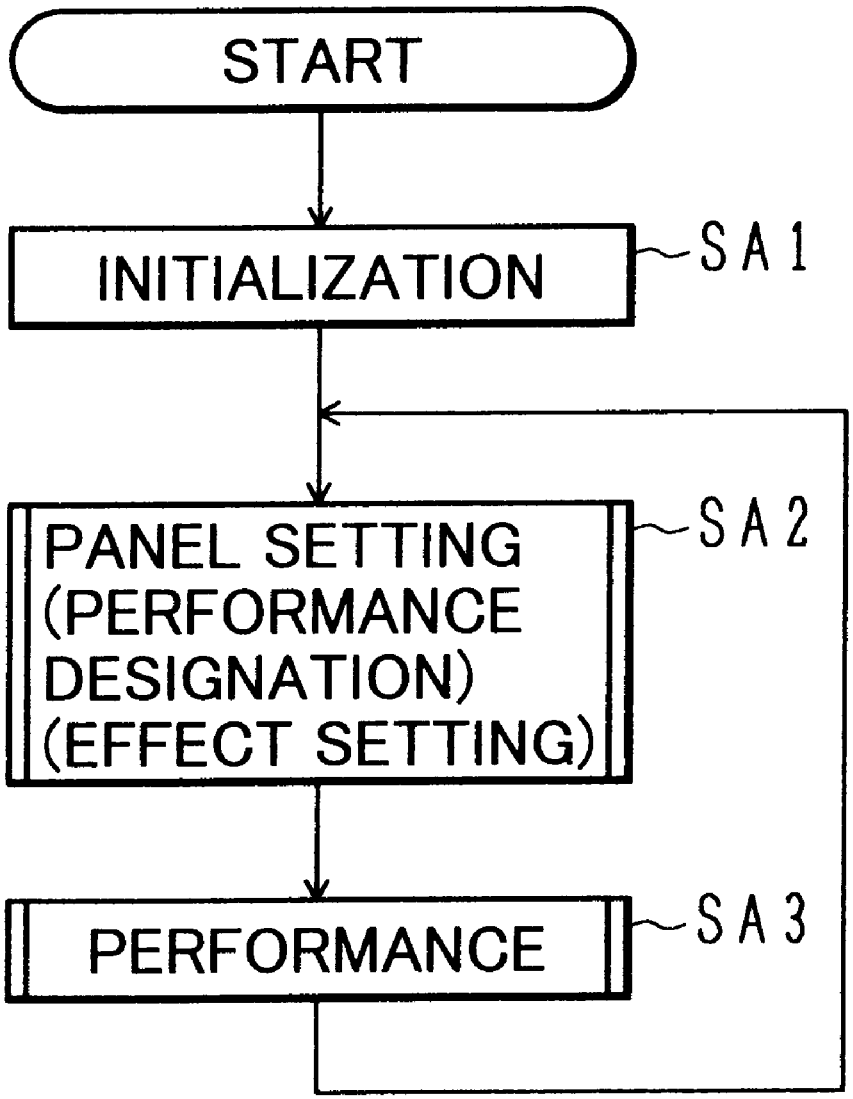
FIG. 7 is a flow chart illustrating a main routine to be executed by a CPU.

FIG. 7 is a flow chart illustrating a main routine to be executed by CPU 12.

At Step SA1, the music apparatus is initialized. For example, buffers, registers and flags are initialized.

At Step SA2, a setting process is executed by using the console panel 19 (FIG. 6). As a player operates upon an operator of the console panel 19, a corresponding setting process is executed. The setting process includes a performance designation process of designating a start or stop of performance and an effect setting process of setting effect parameters.

The details of the performance designation process will be given later with reference to the flow chart of FIG. 10, and the details of the effect setting process will be given later with reference to the flow chart of FIG. 8.

At Step SA3, a performance process is executed in accordance with the contents entered by the effect setting process, to produce original sounds and predefined effect sounds. The details of the performance process will be given later with reference to the flow chart shown in FIG. 11. After the performance process, the routine returns to Step SA2 to repeat the above described processes.

Figure 8:
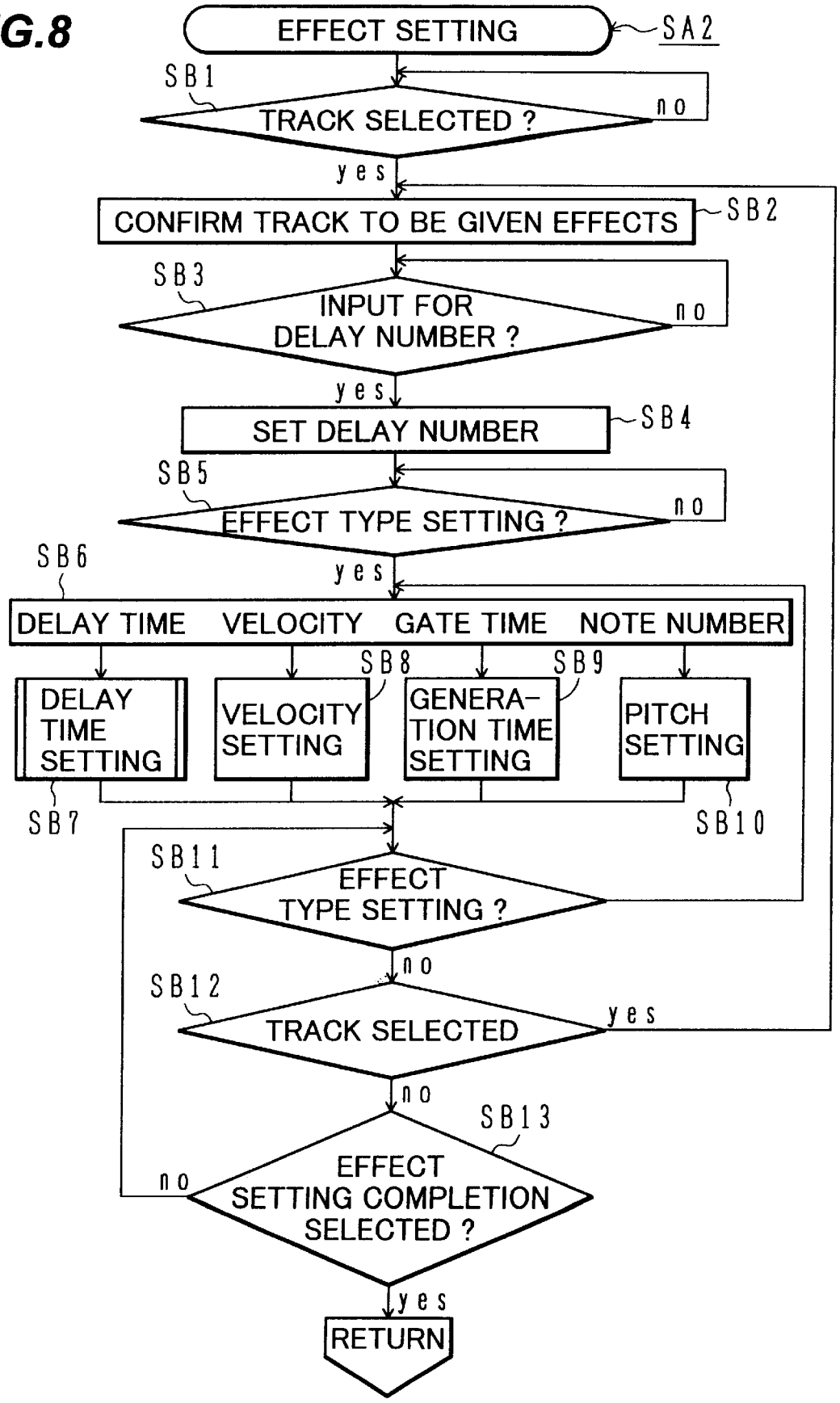
FIG. 8 is a flow chart illustrating the details of an effect setting process at Step SA2 shown in FIG. 7.

FIG. 8 is a flow chart illustrating the details of the effect setting process at Step SA2 shown in FIG. 7.

At Step SB1, it is checked whether a track is selected through a panel operation by a player. The track corresponds to the channel number shown in FIGS. 2B and 2C. The number of tracks is, for example, 16. The player can select one of the sixteen tracks. If any track is not selected, the player is urged to select a track and the routine stands by until a selection is performed. When a track is selected, the routine advances to Step SB2.

At Step SB2, the selected track is confirmed whether it is a track to be given effects.

At Step SB3, it is checked whether the number of delays (repetition number) is entered through a panel operation by the player. For example, in the example shown in FIG. 3, the number of delays is set to 3. The routine stands by until the number of delays is entered, and if entered, the routine advances to Step SB4.

At Step SB4, the number of delays entered by the player is set.

At Step SB5, it is checked whether an effect type is entered through a panel operation by the player. For example, the effect types include a delay time, a velocity, a gate time, and a note number (pitch).

At Step SB6, the entered effect type is identified. If the entered effect type is the delay time, the routine advances to Step SB7, if it is the velocity, the routine advances to Step SB8, if it is the gate time, the routine advances to Step SB9, and if it is the note number, the routine advances to Step SB10.

At Step SB7, the delay times DT1 to DT3 are set. For example, the delay times DT1 to DT3 (FIG. 3) are set to become sequentially longer by 10%. The details of setting the delay time will be given later with reference to the flow chart shown in FIG. 9.

At Step SB8, the velocities (volume) VEL are set. For example, the velocities are set to become sequentially larger by 10%.

At Step SB9, the gate times (generation times) are set. For example, the gate times GT (FIG. 3) are set to become sequentially shorter by 10%.

At Step SB10, the note numbers (pitches) are set.

After the settings at one of Steps SB7 to SB10, the routine advances to Step SB11. At Step SB11, it is checked whether a new effect type is entered by the player. If entered, the routine returns to Step SB6 to repeat the above Steps. By repeating these operations, a plurality of parameters among the delay times, velocities, gate times, and note numbers can be set.

If it is judged at Step SB11 that there is no effect type entered, the routine advances to Step SB12. At Step SB12, it is checked whether a new track or channel is selected by the player. If selected, the routine returns to Step SB2 to repeat the above Steps. By repeating these operations, settings for a plurality of tracks become possible.

If it is judged at Step SB12 that no track or channel is selected, the routine advances to Step SB13 whereat it is checked whether an effect setting completion is selected by the player. If not, the routine returns along a NO arrow to Step SB11 to repeat the above Steps, whereas if selected, the routine is terminated along a YES arrow to return to the main routine shown in FIG. 7.

Figure 9:
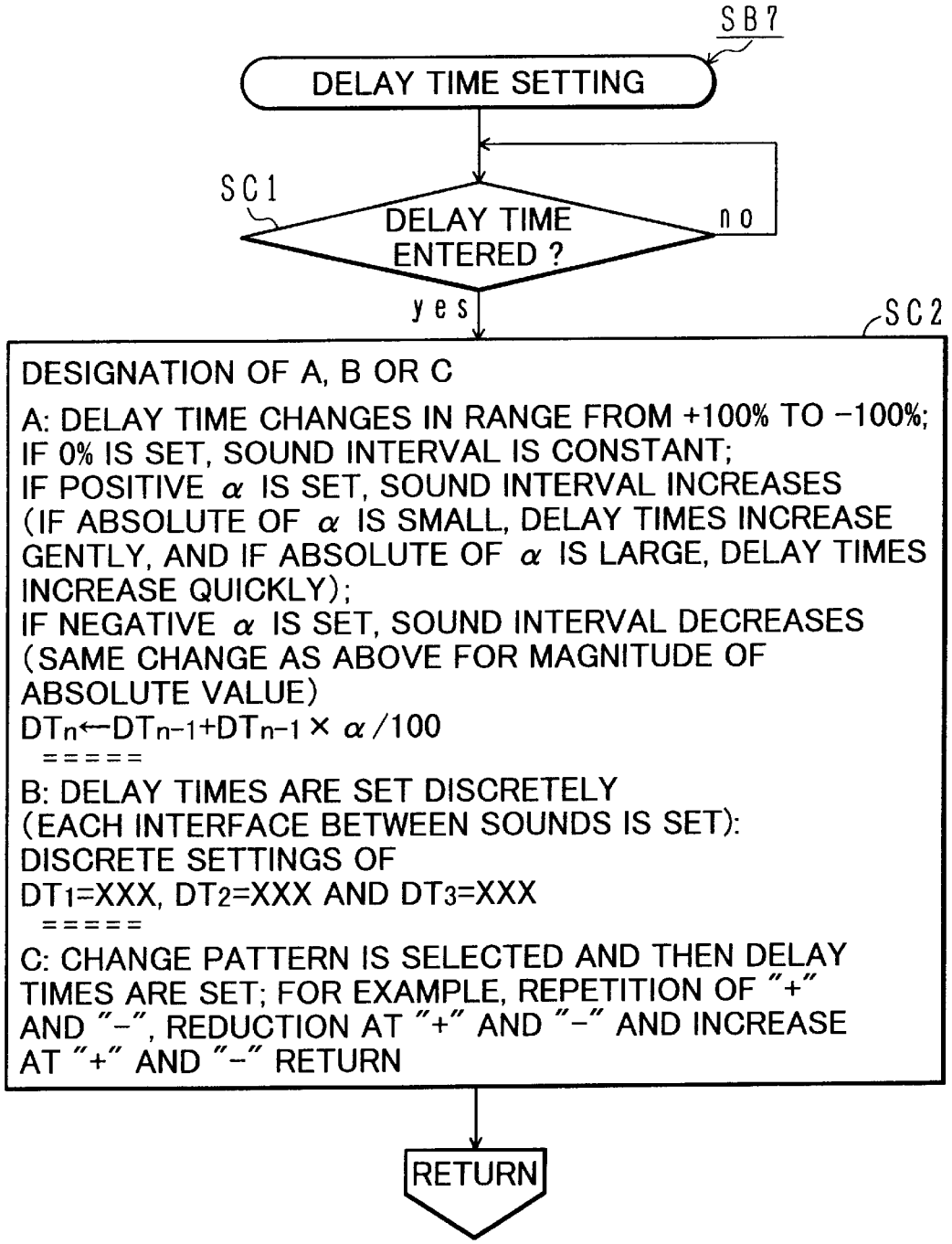
FIG. 9 is a flow chart illustrating the details of a delay time setting process at Step SB7 shown in FIG. 8.

FIG. 9 is a flow chart illustrating the details of the delay time setting process at Step SB7 shown in FIG. 8.

At Step SC1, it is checked whether a delay time is designated through a panel operation by the operator. The routine stands by until a designation by the operator is given. When a designation is given, the routine advances to Step SC2.

At Step SC2, the delay times are set in accordance with the player's designation. Three examples of designations by the player will be described.

With the first designation, the player can change the delay time in a range from +100% to −100%. If 0% is selected, the delay time does not change and becomes constant. In the example shown in FIG. 3, the delay times DT1, DT2 and DT3 are all equal.

If positive 60% is selected, the delay times prolong gradually. In this case, if the absolute value of $\alpha$ is small, the delay times increase gently, whereas it is large, the delay times increase quickly.

The n-th delay time DTn is given by the following equation:

$$DTn=DTn-1+DTn-1\times\alpha/100$$

If the sign of a is alternately exchanged, the delay times can be alternately and repetitively changed between delay time increase and decrease.

With the second designation, the player can set the delay times discretely Namely, in the example shown in FIG. 3, the delay times DT1, DT2 and DT3 can be set discretely.

With the last designation, the player can select a change pattern of delay times and then set a change amount. For example, change patterns include (1) an alternate repetition pattern of delay time increase and decrease, (2) a delay time decreasing pattern, and (3) a delay time increasing pattern.

For example, the change amount can be increased or decreased by using "+" and "−" keys of the console panel 19 (FIG. 6).

Figure 10:
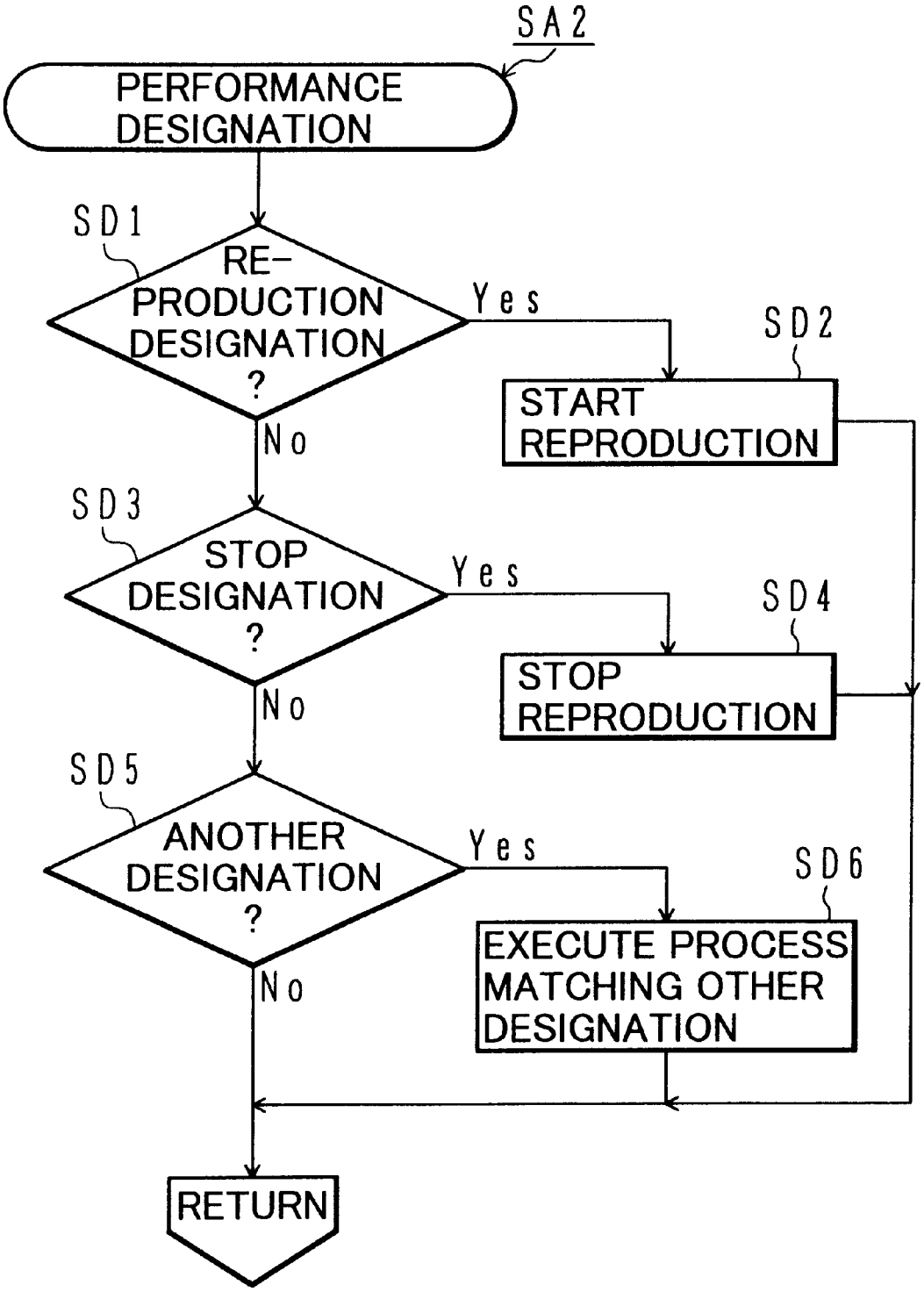
FIG. 10 is a flow chart illustrating the details of a performance designation process at Step SA2 shown in FIG. 7.

FIG. 10 is a flow chart illustrating the details of the performance designation process at Step SA2 shown in FIG. 7.

At Step SD1, it is checked whether a performance reproduction is designated through a panel operation by the player. If designated, the routine advances along a YES arrow to Step SD2 whereat the performance reproduction starts and the routine returns to the main routine shown in FIG. 7. If not designated, the routine advances along a NO arrow to Step SD3.

At Step SD3, it is checked whether a performance reproduction stop is designated through a panel operation by the player. If designated, the routine advances along a YES arrow to Step SD4 whereat the performance reproduction stops and the routine returns to the main routine shown in FIG. 7. If not designated, the routine advances along a NO arrow to Step SD5.

At Step SD5, it is checked whether another designation is given through a panel operation by the player. If given, the routine advances along a YES arrow to Step SD6 whereat a process matching the designation is executed and the routine returns to the main routine shown in FIG. 7. If not given, the routine advances along a NO arrow to return to the main routine shown in FIG. 7.

Figure 11:
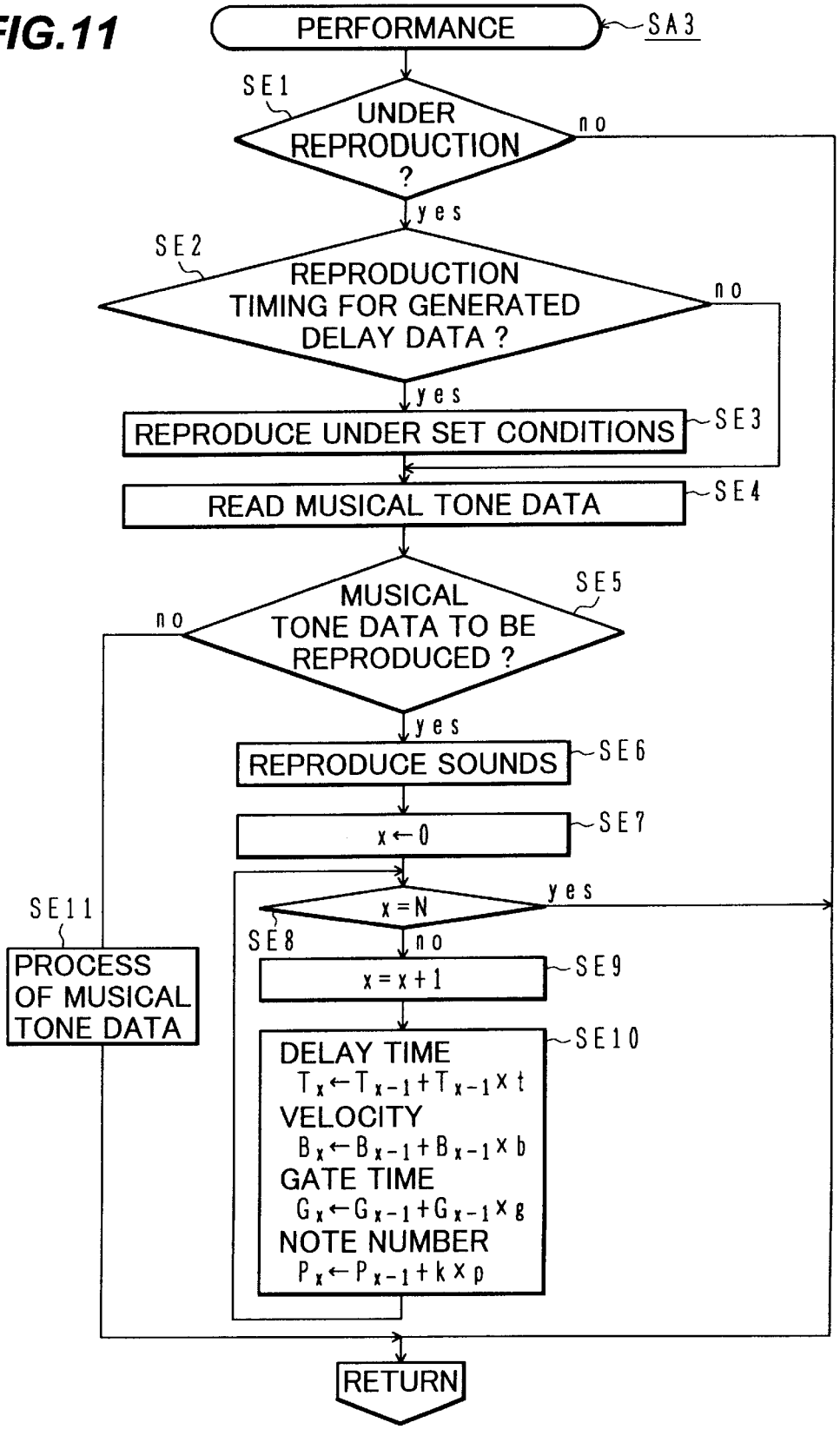
FIG. 11 is a flow chart illustrating the details of a performance process at Step SA3 shown in FIG. 7.

FIG. 11 is a flow chart illustrating the details of the performance process at Step SA3 shown in FIG. 7.

At Step SE1, it is checked whether it is now under performance reproduction. Start and stop of the performance reproduction are activated through a panel operation by the player. If not under the performance reproduction, the routine advances along a NO arrow to the main routine shown in FIG. 7, without executing the following reproduction process. If under the performance reproduction, the routine advances along a YES arrow to Step SE2.

At Step SE2, it is checked whether it is now a reproduction timing for the generated delay data. The delay data is generated at Step SE10 so that it is not still generated at the reproduction start and it is judged that it is not still the reproduction timing. Therefore, the routine advances along a NO arrow to Step SE4.

At Step SE4, musical tone data (performance data) is read. For example, the musical tone data is MIDI data or musical tone parameters and is supplied from RAM 16 (FIG. 6) or interface 20 (FIG. 6).

For example, the routine shown in the flow chart of FIG. 11 is executed at a predetermined time interval to read musical tone data. In this case, it is not necessarily required that the musical tone data exists at the predetermined time interval. If the musical tone data does not exist at the predetermined time interval, the musical tone data may be read at timings corresponding to the interval of the musical tone data.

At Step SE5, it is checked whether the read musical tone data is the data to be reproduced (e.g., key-on event). If the read data is not the data to be reproduced, the routine advances along a NO arrow to Step SE11, whereas if it is the data to be reproduced, the routine advances along a YES arrow to Step SE6.

At Step SE6, a reproduction process is executed by using the read musical tone data. For example, if the musical tone data is a note-on event (NON) (FIG. 2B), then the musical tone parameters for reproduction such as note number (pitch) and velocity (volume) included in the event are supplied to the tone generator 15 (FIG. 6).

At Step SE7, in order to initialize a register x, "0" is set to the register x. The register x identifies the x-th effect sound (delay sound) OUTx.

At Step SE8, it is checked whether the value of the register x is equal to the number N of delays (repetition number) which was set at Step SB4 shown in FIG. 8. In the example shown in FIG. 3, the delay number N is 3. If both the numbers are different, the routine advances to Step SE9.

At Step SE9, the value of the register x is incremented by "1".

At Step SE10, the delay time Tx, velocity Bx, gate time Gx, and note number Px respectively for the x-th delay sound OUTx are set by using the following equations.

Figure 12:
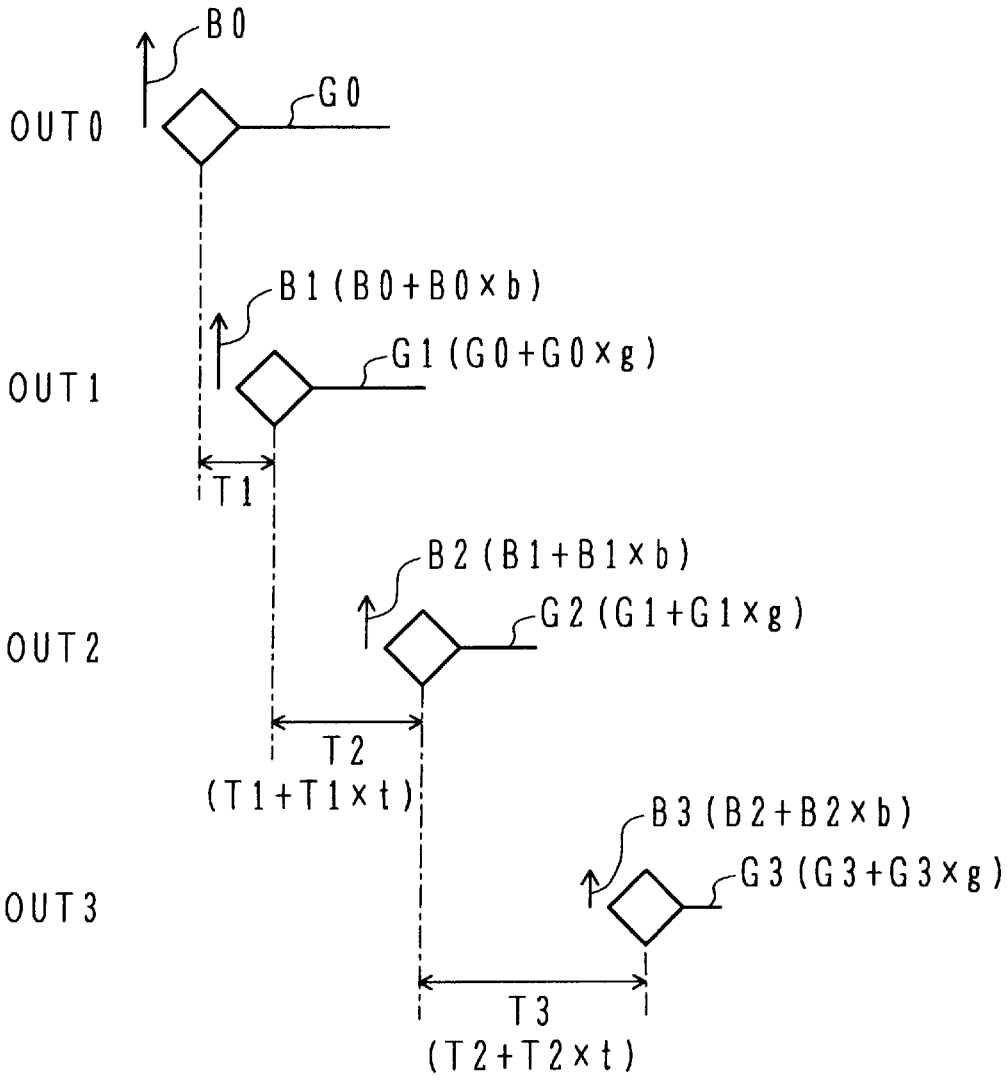
FIG. 12 is a diagram showing examples of parameter settings.

With reference to FIG. 12, a method of setting each parameter will be described. Similar to the example shown in FIG. 3, it is assumed that the repetition number N is 3 and three delay sounds OUT1 to OUT3 are generated for the original sound OUT0.

(1) Delay time: Tx=Tx−1+Tx−1xt

The first delay time T1 is set by the player, and the second delay time T2 and following delay times are set by using the above equation. A change amount t is set by the player in a range, for example, from −1.00 to +1.00.

(2) Velocity: Bx=Bx−1+Bx−1xb

A velocity B0 is the velocity of the original sound OUT0, and corresponds for example to a velocity in the note-on event NON (FIG. 2B). A change amount b is set by the player in a range, for example, from −1.00 to +1.00.

(3) Gate time: Gx=Gx−1+Gx−1xg

A gate time G0 is the gate time of the original sound OUT0, and is determined for example by a time between the note-on event and note-off event. A change amount g is set by the player in a range, for example, from −1.00 to +1.00.

(4) Note number: Px=Px−1+Px−1xp

A note number P0 is the note number of the original sound OUT0, and corresponds for example to the note number in the note-on event NON (FIG. 2B). A change amount p of the note numbers is set by the player in a range, for example, from −1.00 to +1.00.

When the value of the register x takes "1", the above parameters for the first delay sound OUT1 are set. Thereafter, the routine returns to Step SE8 and at Step SE9 the value of the register x is set to "2". At Step SE10, the parameters for the second delay sound OUT2 are set. Until the value of the register x takes the delay number N, the above operations are repeated. When the value of the register x reaches the delay number N, at Step SE8 the routine advances along the YES arrow to return to the main routine shown in FIG. 7.

The performance process shown in FIG. 11 is executed at the predetermined time interval. After the parameters are set, at Step SE2 it is checked whether it is now the sound generation timing for the set delay sound. If not, the routine advances along the NO arrow to Step SE4 to read the next musical tone data, whereas if it is the timing, the routine advances along the YES arrow to Step SE3.

At Step SE3, the sound generation process for the delay sound is executed by using the set parameters. Thereafter, at Step SE4 the next musical tone data is read.

In addition to the above-described parameters, a sound image orientation (pan) may be set for each delay sound.

As described so far, according to the embodiment, performance information such as MIDI data and musical tone parameters are supplied to generate original sounds and effect sounds (delay sounds). In accordance with the supplied performance information, the performance information (original sounds) and/or arranged performance information (effect sounds) can be generated repetitively. Each performance information repetitively generated may be arranged in different ways. Subjects to be arranged may be a delay time, velocity, gate time and/or note number.

Each piece of performance information may be arranged independently or collectively by using a predetermined function such as a sequential increase function of the parameter value by 10% or by using preset values.

A known effector can only set the echo degree larger or smaller. According to the embodiment, as different from the known effector, the number of delays (repetition time) can be set and, in addition, each delay sound (effect sound) can be arranged in a different way to have different parameters.

The input performance data representative of original sound may be a single sound, phrase or music. If the embodiment is applied to a sequencer, a song mode and a pattern mode may be provided. When the song mode is selected, one piece of music data is played. When the pattern mode is selected, one phrase (e.g., one to four bars) is repetitively played.

For example, if delay sounds are added to the original sound phrase, novel sound effects can be provided. For example, it is possible to change rhythm and enhance original sounds.

Sounds when a ball is dropped on a floor can be simulated as described with FIGS. 4A and 4B. Doppler effects of a moving sound source, such as a train and a car moving toward and away from an object, can also be simulated. The number of variations of effects to be added to musical sounds can be increased.

Figure 13:
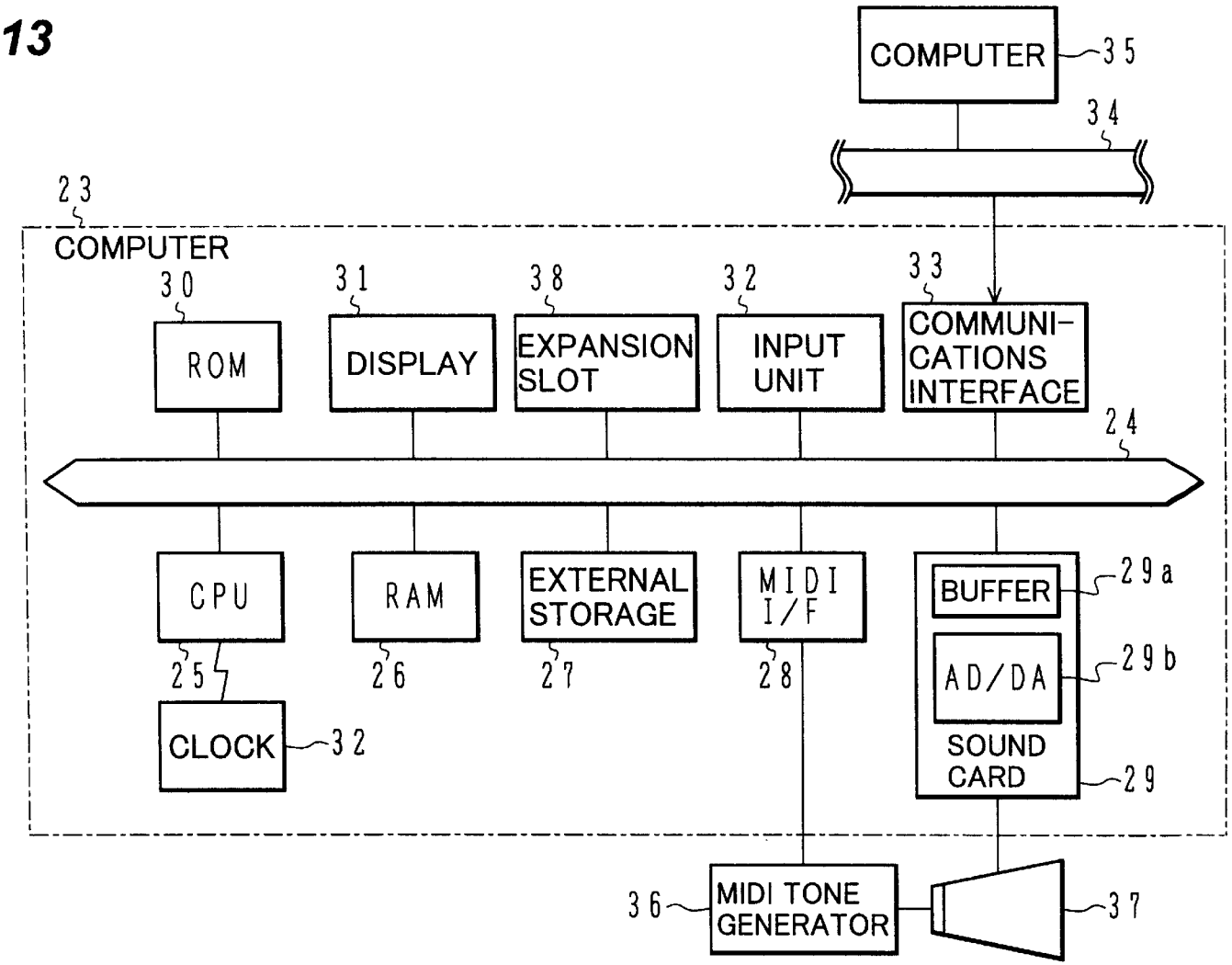
FIG. 13 is a block diagram showing the hardware structure of a music apparatus.

FIG. 13 is a block diagram showing the specific hardware structure of a general computer or personal computer 23 constituting a music apparatus.

The structure of the general computer or personal computer 23 will be described with reference to FIG. 13. Connected to a bus 24 are a CPU 25, a RAM 26, an external storage unit 27, a MIDI interface 28 for transmitting/receiving MIDI data to and from an external circuit, a sound card 29, a ROM 30, a display 31, an input unit 32 such as a keyboard, switches and mouse, a communications interface 33 for connection to a network, and an expansion slot 38.

The sound card 29 has a buffer 29*a* and a codec circuit 29*b*. The buffer 29*a* buffers data to be input from or output to the external circuit. The codec circuit 29*b* has an A/D converter and a D/A converter and converts analog data into digital data or vice versa. The codec circuit 29*b* also has a compression/expansion circuit for compressing/expanding data.

The external storage unit 27, ROM 30, RAM 26, CPU 25 and display 31 are equivalent to the storage unit 18, ROM 13, RAM 14, CPU 12, and display 25 respectively shown in FIG. 6. A system clock 32 generates time information. In accordance with the time information supplied from the system clock 32, CPU 25 can execute a timer interrupt process.

The communications interface 33 of the general computer or personal computer 23 is connected to the network 34. The communications interface 33 is used for transmitting/receiving MIDI data, audio data, image data, computer programs or the like to and from the communications network.

The MIDI interface 28 is connected to a MIDI tone generator 36, and the sound card 29 is connected a sound output apparatus. CPU 25 receives MIDI data, audio data, image data, computer programs or the like from the communications network 34 via the communications interface 33.

The communications interface 33 may be an Internet interface, an Ethernet interface, a digital communications interface of IEEE 1394 standards, or an RS-262C interface, to allow connection to various networks.

The general computer or personal computer 23 stores therein computer programs for reception, reproduction and the like of audio data. Computer programs, various parameters and the like may be stored in the external storage unit 27 and read into RAM 26 to facilitate addition, version up and the like of computer programs and the like.

The external storage unit 27 may be a hard disk drive or a CD-ROM (compact disk read-only memory) drive which reads computer programs and the like stored in a hard disk or CD-ROM. The read computer programs and the like may be stored in RAM 26 to facilitate new installation, version-up and the like.

The communications interface 33 is connected to the communications network 34 such as the Internet, a local area network (LAN) and a telephone line, and via the communications network 34 to another computer 35.

If computer programs and the like are not stored in the external storage unit 27, these programs and the like can be downloaded from the computer 35. In this case, the general computer or personal computer 23 transmits a command for downloading a computer program or the like to the computer 35 via the communications interface 33 and communications network 34.

Upon reception of this command, the computer 35 supplies the requested computer program or the like to the general computer or personal computer 23 via the communications network 34. The general computer or personal computer 23 receives the computer program or the like via the communications interface 33 and stores it in the external storage unit 27 to complete the download.

This embodiment may be reduced into practice by a commercially available general computer or personal computer installed with computer programs and the like realizing the functions of the embodiment.

In this case, the computer programs and the like realizing the functions of the embodiment may be supplied to a user in the form of a computer readable storage medium such as a CD-ROM and a floppy disk.

If the general computer or personal computer is connected to the communications network such as the Internet, a LAN and a telephone line, the computer programs and the like may be supplied to the general computer or personal computer via the communications network.

The present invention has been described in connection with the preferred embodiments. The invention is not limited only to the above embodiments. It is apparent that various modifications, improvements, combinations, and the like can be made by those skilled in the art.

What is claimed is:

1. A music apparatus comprising:

a processor;

a waveform generator; and a program memory storing instructions for causing the processor to execute a musical sound generating process according to first performance information, the musical sound generating process comprising the steps of:

(a) receiving the first performance information;

(b) creating second performance information according to said received first performance information or third performance information formed by processing said created second performance information;

(c) selectively repeating said creating step (b);

(d) selectively designating said repeatedly creating step (c) to create fourth performance information different from the previously created performance information; and (e) generating musical sound according to the second, third or fourth performance information.

2. A music apparatus comprising:

a processor;

an input device for inputting first performance information;

a waveform generator; and a program memory storing instructions for causing the processor to execute a musical sound generating process according to the first performance information, the musical sound generating process comprising the steps of:

(a) inputting the first performance information;

(b) creating second performance information according to said input first performance information or third performance information formed by processing said created second performance information;

(c) selectively repeating said creating step (b);

(d) selectively designating said repeatedly creating step (c) to create fourth performance information different from the previously created performance information; and (e) selectively controlling number of repeating said repeatedly creating step (c); and (f) generating musical sound according to the second, third or fourth performance information.

3. A storage medium for a program comprising instructions for causing a processor to execute a musical sound generating process according to first performance information, the musical sound generating process comprising the steps of:

(a) receiving the first performance information;

(b) creating second performance information according to said received first performance information or third performance information formed by processing said created second performance information;

(c) selectively repeating said creating step (b);

(d) selectively designating said repeatedly creating step (c) to create fourth performance information different from the previously created performance information; and (e) generating musical sound according to the second, third or fourth performance information.

4. A storage medium for a program comprising instructions for causing a processor to execute a musical sound generating process according to first performance information, the musical sound generating process comprising the steps of:

(a) inputting the first performance information;

(b) creating second performance information according to said input first performance information or third performance information formed by processing said created second performance information;

(c) selectively repeating step (b);

(d) selectively designating said repeatedly creating step (c) to create fourth performance information different from the previously created performance information; and (e) selectively controlling number of repeating said repeatedly creating step (c); and (f) generating musical sound according to the second, third or fourth performance information.

5. A musical sound generating method according to first performance information comprising the steps of:

(a) receiving the first performance information;

(b) creating second performance information according to said received first performance information or third performance information formed by processing said created second performance information;

(c) selectively repeating said creating step (b);

(d) selectively designating said repeatedly creating step (c) to create fourth performance information different from the previously created performance information; and (e) generating musical sound according to the second, third or fourth performance information.

6. A musical sound generating method according to first performance information comprising the steps of:

(a) inputting the first performance information;

(b) creating second performance information according to said input first performance information or third performance information formed by processing said created second performance information;

(c) selectively repeating said creating step (b);

(d) selectively designating said repeatedly creating step (c) to create fourth performance information different from the previously created performance information; and (e) selectively controlling number of repeating said repeatedly creating step (c); and (f) generating musical sound according to the second, third or fourth performance information.

7. A music apparatus comprising:

means for processing;

means for generating waveform; and means for storing instructions for causing the processing means to execute a musical sound generating process according to first performance information, the musical sound generating process comprising the steps of:

(a) receiving the first performance information;

(b) creating second performance information according to said received first performance information or third performance information formed by processing said created second performance information;

(c) selectively repeating said creating step (b);

(d) selectively designating said repeatedly creating step (c) to create fourth performance information different from the previously created performance information; and (e) generating musical sound according to the second, third or fourth performance information.

8. A music apparatus comprising:

means for processing;

means for inputting first performance information;

means for generating waveform;

means for storing instructions for causing the processing means to execute a musical sound generating process according to the first performance information, the musical sound generating process comprising the steps of:

(a) inputting the first performance information;

(b) creating second performance information according to said input first performance information or third performance information formed by processing said second performance information;

(c) selectively repeating said creating step (b);

(d) selectively designating said repeatedly creating step (c) to create fourth performance information different from the previously created performance information; and (e) selectively controlling number of repeating said repeatedly creating step (c); and (f) generating musical sound according to the second, third or fourth performance information.

* * * * *